United States Patent [19]

Fyfe

[11] 3,951,562

[45] Apr. 20, 1976

[54] EXPANSION JOINT

[75] Inventor: Edward Robert Fyfe, Burlington, Canada

[73] Assignee: Elastometal Limited, Burlington, Canada

[22] Filed: Sept. 27, 1974

[21] Appl. No.: 509,780

Related U.S. Application Data

[63] Continuation-in-part of Ser. No. 330,551, Feb. 8, 1973, abandoned.

[52] U.S. Cl. ..... 404/68; 404/72; 52/396

[51] Int. Cl.[2] ..... E01C 11/02

[58] Field of Search ..... 404/68, 69, 72; 14/16; 52/396, 403; 49/479, 486, 489

[56] References Cited

UNITED STATES PATENTS

| | | | |
|---|---|---|---|
| 1,918,554 | 7/1933 | Older | 404/69 |
| 3,165,987 | 1/1965 | Hirst | 404/47 |
| 3,172,237 | 3/1965 | Bradley | 404/64 X |
| 3,316,574 | 5/1967 | Pare | 404/47 X |
| 3,394,639 | 7/1968 | Viehmann | 404/47 |
| 3,455,215 | 7/1969 | Webb | 404/69 |
| 3,570,378 | 3/1971 | Honegger | 404/69 |
| 3,626,822 | 12/1971 | Koster | 404/69 |
| 3,850,539 | 11/1974 | Bowman | 404/69 |
| 3,854,835 | 12/1974 | Stog | 404/68 |

*Primary Examiner*—Nile C. Byers
*Attorney, Agent, or Firm*—Hirons & Rogers

[57] ABSTRACT

An elongated expansion joint of the kind used between adjacent slabs in a road or building construction comprises, a pair of elongated anchor elements or rigid polymeric material adapted to be secured to the respective slab edges, and a laterally compressible web of more flexible material securable between the two anchor elements. At least one of the anchor elements may be secured to the web by means of a bead which snaps into a channel. The web may be of folded configuration with a rupturable membrane to hold the web to a predetermined spacing. The invention also comprises a method of forming an expansion joint between a pair of surfaces using a structure as specified.

12 Claims, 6 Drawing Figures

EXPANSION JOINT

CROSS-REFERENCE TO RELATED APPLICATION

This application is a continuation-in-part of my application Ser. No. 330,551, filed Feb. 8, 1973, now abandoned.

FIELD OF THE INVENTION

The present invention relates to expansion joints of the kind that are used between the edge surfaces of adjacent slabs of thermally expansive material (such as steel or concrete) used in the construction of roadways, walkways, bridges, and the like.

The invention also relates to a method of forming an expansion joint between a pair of such slabs.

PREVIEW OF THE PRIOR ART

In accordance with established practice in the construction of roadways, walkways, bridges and the like, concrete slabs of selected length are cast in situ along and upon a previously prepared roadbed, formed for example of compacted crushed gravel to other suitable aggregrate material. To allow for expansion of the concrete during hot weather, a gap of predetermined width is left between the parallel edge surfaces of immediately adjacent slabs. It is the practice to bridge or close this gap with an expansion joint, which usually must be liquid impermeable to thereby keep water from running between and under the slabs where it could freeze and cause heaving of the slabs during cold weather. The joint may also be required to serve as a supporting surface for vehicular and predestrian traffic. Where required, a layer of asphalt may, of course, be applied onto the upper surface of each concrete slab by hot-rolling or the like.

One prior art expansion joint utilizes a pair of stainless steel extrusions and an accordian-section web with bead-shaped edges, the web being formed from a flexible polymeric material such as neoprene. The steel extrusions serve as anchor elements for the web and are bolted, cast in place or otherwise secured to the respective edge surfaces of a pair of adjacent concrete slabs. The web is then forced between the extrusions until its bead-shaped edges slip into cooperating channels provided in the extrusions. A suitable high strength adhesive is usually preloaded in the channels to bond each edge of the web to its respective steel extrusion.

Such an expansion joint entails a number of disadvantages. In particular, the stainless steel material of which the extrusions are formed is not only very expensive but is heavy and therefore difficult to handle. Moreover, because of the dissimilarity of materials, a poor bond is sometimes formed between the polymeric web and the steel extrusion. Furthermore, the aforesaid method of assembling the prior art expansion joint is both laborious and time-consuming, in that is requires individual handling of each of the three expansion joint components; the pair of steel extrusions and the flexible polymeric web.

DEFINITION OF THE INVENTION

An object of the invention is to provide an expansion joint that utilizes anchor elements which are cheaper, lighter, and bond better to the polymeric web, while retaining the corrosion-resistant property of stainless steel.

Another object of the invention is to provide a fast and simple method for forming an expansion joint between adjacent slabs which entails handling of fewer separate components.

In accordance with the present invention there is provided an expansion joint for joining a pair of substantially parallel edge surfaces of adjacent slabs, said expansion joint comprising:

a. a pair of elongated anchor elements of a substantially rigid polymeric material, each adapted to extend along the edge surface of a respective one of said slabs;

b. securing means on each anchor element for securing the respective element to the respective slab edge;

c. a laterally compressible and extensible elongate web of normally folded configuration, of more flexible polymeric material than the said anchor elements and having two parallel longitudinal edges which in the completed joint are permanently secured to respective ones of the said anchor elements; and d. spacing means interposed between the anchor elements for maintaining them at a preselected spacing to one another until said elements are secured to the respective slabs, said spacing means comprising an extensible membrane joined to the folds of the web to resist spreading thereof, said membrane being adapted to rupture during normal movement of said slab surfaces away from each other in operation.

Also according to the invention there is provided an expansion joint web element for use in an expansion joint for joining a pair of substantially parallel edge surfaces of adjacent slabs, said joint comprising a pair of elongated anchor elements of a substantially rigid polymeric material, each adapted to extend along the edge surface of a respective one of said slabs, securing means on each anchor element for securing the respective element to the respective slab edge, and the web element which in the completed joint is permanently secured to and extends between the two anchor elements, wherein the said web element comprises an elongate member of normally longitudinally folded configuration to be compressible and extensible transversely of the length of the anchor elements, the member having two longitudinal edges which in the completed joint are permanently secured to respective ones of the said anchor elements, and the member having an extensible membrane joined to the folds of the web to resist spreading thereof, thereby constituting spacing means for the said anchor elements for maintaining them at a predetermined spacing from one another, said membrane being adapted to rupture during normal movement of said slab surfaces away from each other in operation.

Further in accordance with the invention there is provided a method of forming an expansion joint between a pair of substantially parallel edge surfaces of adjacent slabs of settable material, said expansion joint comprising first and second elongate anchor elements of substantially rigid polymeric material and an elongate, laterally compressible and extensible web of substantially more flexible polymeric material than that of the said anchor elements with the longitudinal edges thereof secured permanently to the respective anchor elements, wherein at least one of the two longitudinal edges of the web has a pronounced bead and a corresponding first one of the anchor elements has a channel adapted to receive and retain the said bead said method comprising the steps of:

a. casting a first slab with the said first anchor element embedded therein to be thereby secured thereto, b. with the second anchor element permanently joined to the respective longitudinal edge of the web inserting the said bead in the channel of the first anchor element and permanently securing it therein by means of an adhesive, the anchor elements being positioned at a preselected spacing from one another, and c. casting a second slab with the second anchor element embedded therein to be thereby secured thereto.

DESCRIPTION OF THE DRAWINGS

For a better understanding of the invention and its advantages, particular preferred embodiments thereof will now be described, by way of example, with reference to the accompanying diagrammatic drawings wherein:

FIGS. 2*a*, 2*b* and 2*c* are sequentive cross-sectional enlarged views in elevation taken along line 11 — 11 of FIG. 1, wherein FIGS. 2*a* and 2*b* illustrate one constructive embodiment, FIGS. 3*a* and 3*b* are sequentive cross-sectional enlarged views in elevation taken along the said line 11 — 11 to illustrate another constructive embodiment and method of the invention.

DESCRIPTION OF THE PREFERRED EMBODIMENTS

Throughout the various figures of the drawings, like reference numbers are used to denote like elements.

Figure 1:
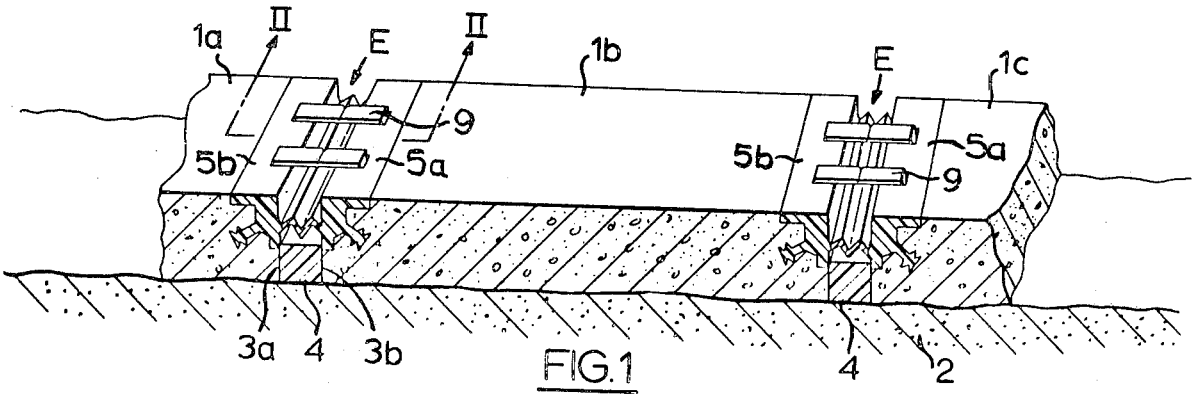
FIG. 1 is a perspective view, partly in section, of a roadbed utilizing expansion joints formed in accordance with the invention.

FIG. 1 shows several slabs 1*a*, 1*b*, 1*c* of a settable material such as concrete supported upon a roadbed 2 of compacted crushed gravel or the like. Adjacent slabs are separated by a gap of a size preselected to allow for thermal expansion and contraction of the slabs during changes in the ambient temperature. An elongated block 4 of resistingly compressible material, such as styrofoam, may be used as a spacing gauge to determine the width of the gap between immediately adjacent concrete slabs 1*a*, 1*b* and 1*b*, 1*c*. An expansion joint (generally designated by the reference E) bridges each gap by joining each pair of substantially parallel edge surfaces (for example the surfaces 3*a*, 3*b*) of adjacent slabs. Such expansion joints constitute liquid impermeable seals to keep water from running between and under the slabs where it could freeze and cause heaving of the slabs, or in the case of a roof construction leak through into the structure below.

Figure 2A:
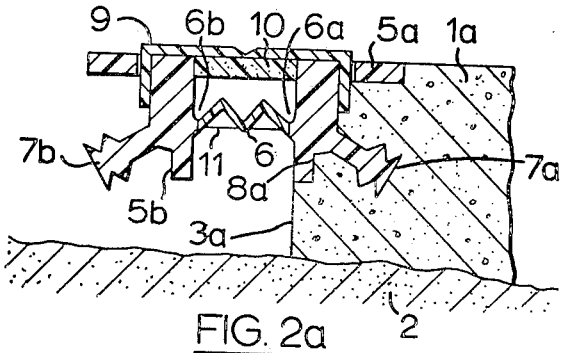
Figure 2B:
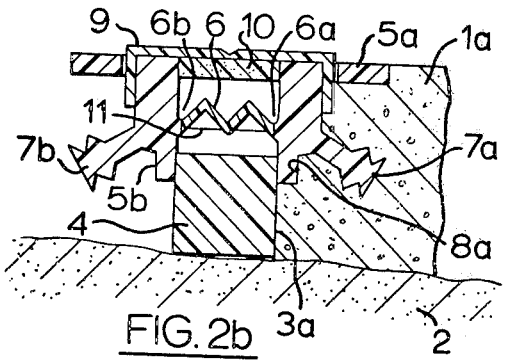
Figure 2C:
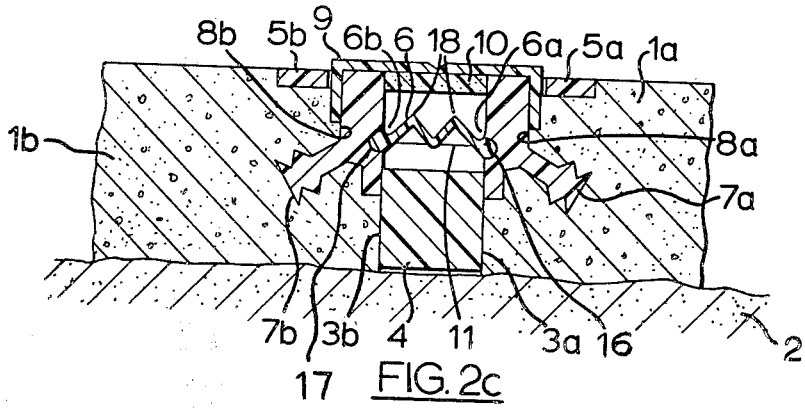

As illustrated in greater detail in FIGS. 2*a*, 2*b*, 2*c*, a novel expansion joint of this invention comprises a pair of elongated anchor elements 5*a*, 5*b* of a substantially rigid polymeric material, and an elongated, laterally compressible and extensible web 6 of a polymeric material substantially more flexible than that used for the anchor elements. Each of the anchor elements 5*a*, 5*b* is shaped to form an edge for the respective slab and also to create a respective recess formation 8*a*, 8*b* extending along the corresponding edge surface 3*a* or 3*b*. Securing means 7*a*, 7*b* are also provided extending from the respective anchor elements for securing each element 5*a* or 5*b* to a respective one of the slabs 1*a*, 1*b*. At least one longitudinal edge 6*b* of the web 6 is permanently secured to anchor element 5*b* before securing of either anchor element 5*a*, 5*b* to its respective slab 1*a*, 1*b*. The other longitudinal edge 6*a* of web 6 is permanently secured to anchor element 5*a* at least before both anchor elements 5*a*, 5*b* are secured to their respective slabs 1*a*, 1*b* by casting of the said slabs with the anchor elements in place.

Preferably, the expansion joint also comprises spacing means which in this embodiment are constituted by a breakable clamp 9, a compressible mass 10, and rupturable membrane 11, these spacing means maintaining anchor elements 5*a* , 5*b* at a preselected spacing to each other until they are secured to slabs 1*a*, 1*b*. As illustrated in FIGS. 2*a*, 2*b* and 2*c*, the breakable clamps 9 are C-shaped and of plastic material or the like, being spaced along the expansion joint with their free ends engaged in cooperating slots in the anchor elements 5*a*, 5*b*, thereby preventing separation thereof. The clamps are adapted to break under the normal thermal expansion and compression of slabs 1*a*, 1*b*. Movement of the anchor elements 5*a*, 5*b*, toward one another is prevented by a compressible mass 10, e.g., asphalt, disposed between the anchor elements. A resistingly extensible membrane 11 is adapted to rupture during movement of the edges of the slabs 1*a*, 1*b*, away from one another and may be used instead or in addition to prevent separation of anchor elements 5*a*, 5*b* during installation of the expansion joint.

Depending upon local circumstances, preferences and like special considerations, any of a variety of securing means 7*a*, 7*b* may be employed to secure anchor elements 5*a*, 5*b* to slabs 1*a*, 1*b*. For example, as described above, the securing means of FIGS. 2*a*, 2*b*, 3*a*, and 3*b* comprises an integral anchor portion for each anchor element 5*a* and 5*b*, the concrete slabs 1*a* and 1*b* being cast in place around them.

In the embodiments particularly described both web 6 and anchor elements 5*a*, 5*b* are composed of polymeric material, which is less expensive and less cumbersome to handle during installation than the steel anchor elements commonly used hitherto. By way of example only, the web 6 may be composed of neoprene, whereas the anchor elements may be composed of rigid polystyrene.

Because of their similar material composition, the web 6 and at least one of anchor elements 5*a*, 5*b* may be formed integrally by co-extrusion, resulting in a highly effective liquid impermeable junction therebetween.

In a construction in which both anchor elements 5*a*, 5*b* are co-extruded with web 6, then membrane 11 may also be co-extruded in joined relation to the folds of web 6 to resist spreading thereof, thereby providing in a minimum number of manufacturing operations a substantially complete expansion joint permitting simple installation.

In a construction in which only one anchor element 5*b* is co-extruded with, and integrally joined to one longitudinal edge 6*b* of web 6, the other longitudinal edge 6*a* may be formed with a pronounced bead 16 which may be subsequently bonded to anchor element 5*a*. For this purpose, in the embodiment illustrated anchor element 5*a* is provided with a channel 17 adapted to mate with bead 16 so as to receive it and mechanically retain it therein. The bead 16 subsequently is permanently secured in this channel by means of an adhesive such as an epoxy resin, which is particularly well suited for bonding between polymeric materials.

FIGS. 2*a*, 2*b* and 2*c* also illustrate a preferred sequence of steps in carrying out one method of installing an expansion joint in accordance with the invention.

With web 6 secured permanently to both anchor elements 5*a* , 5*b* (as by co-extrusion or adhesive bonding), the anchor elements are positioned at a preselected spacing, the means 9, 10, 11 being applied to maintain the anchor elements 5*a*, 5*b* at the preselected spacing, as described above. As shown in FIG. 2*a*, slab 1*a* is then cast to mold securely to anchor element 5*a*. As shown in FIG. 2*b*, a block 4 of resistingly compressible material such as styrofoam is then positioned contiguous to edge surface 3*a*, whereupon concrete slab 1*b* is cast to mold securely to the anchor element 5*b*, the block 4 serving as a form for spacing the formation of edge surface 3*b*.

FIG. 2*c* also illustrates an embodiment in which the web 6 is provided along both of its longitudinal edges with respective pronounced beads 16 each of which may be bonded at the appropriate time to the respective anchor element. Thus both edges may be bonded prior to installation of the joint, or one may be bonded prior to installation and the other after installation, or both may be inserted into their respective channels and bonded to their respective anchor elements after the installation of the elements.

Figure 3A:
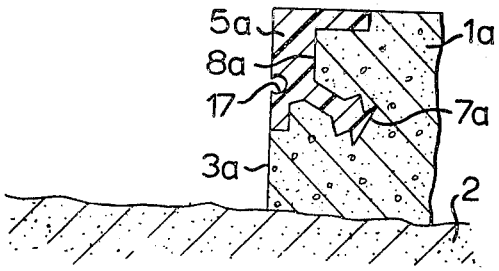
FIG. 3*a* illustrates another constructive embodiment, and the three figures together illustrate a method of the invention of forming an expansion joint.
Figure 3B:
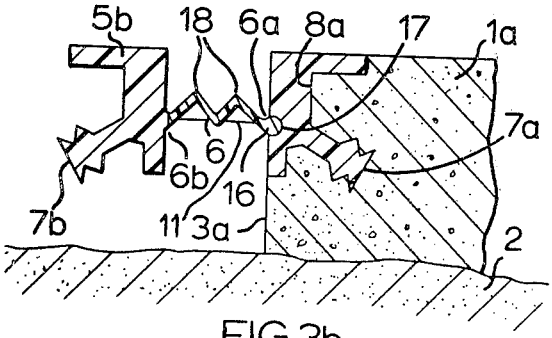

FIGS. 3*a* and 3*b* also illustrate part of the sequence of steps in carrying out another method embodying the invention. As shown in FIG. 3*a*, concrete slab 1*a* is cast to mold securely to anchor element 5*a*, which is provided with the above-described channel 17, bead 16 is then permanently secured in channel 17 by means of an adhesive. With web 6 secured permanently to anchor elements 5*a*, 5*b*, they are positioned at a preselected spacing, spacing means being applied to maintain the anchor elements at the preselected spacing. For example, as described in relation to FIGS. 2*b* and 2*c*, a block 4 may be positioned beneath the joint and concrete slab 1*b* cast to mold to ahcnor element 5*b*.

I claim:

1. An expansion joint for joining a pair of substantially parallel edge surfaces of adjacent slabs, said expansion joint comprising:

a. a pair of elongated anchor elements of a substantially rigid polymeric material, each adapted to extend along the edge surface of a respective one of said slabs;

b. securing means on each anchor element for securing the respective element to the respective slab edge;

c. a laterally compressible and extensible elongate web of normally folded configuration, of more flexible polymeric material than the said anchor elements and having two parallel longitudinal edges which in the completed joint are permanently secured to respective ones of the said anchor elements; and d. spacing means interposed between the anchor elements for maintaining them at a preselected spacing to one another until said elements are secured to the respective slabs, said spacing means comprising an extensible membrane joined to the folds of the web to resist spreading thereof, said membrane being adapted to rupture during normal movement of said slab surfaces away from each other in operation.

2. An expansion joint as claimed in claim 1, wherein one of the said web longitudinal edges is permanently secured to one of the anchor elements before securing of either anchor element to a slab, and the other of the said web longitudinal edges is permanently secured to the other anchor element at least before securing of both of the anchor elements to the respective slab.

3. An expansion joint as claimed in claim 1, wherein said salbs are of a settable material, and said securing means comprise an integral anchor portion of each anchor element, the settable material being cast to surround the integral anchor portion and thereby secure the anchor elements to the respective slabs.

4. An expansion joint as claimed in claim 3, wherein one of said two longitudinal edges of said elongate web has a pronounced bead, and the respective anchor element has a channel adapted to receive and retain said bead, said bead being permanently secured in said channel after insertion therein by means of an adhesive.

5. An expansion joint as claimed in claim 1, wherein said web has at least one ridge coplanar with the upper surfaces of said slabs.

6. An expansion joint as claimed in claim 1, wherein said spacing means also comprise;

a breakable clamp engaging both anchor elements to prevent separation thereof away from one another, said clamp being adapted to break during normal separation of said slabs in operation, and a mass of compressible material disposed between the anchor elements to resist movement thereof toward one another.

7. An expansion joint as claimed in claim 1, wherein said web and at least one of said anchor elements is formed integrally as a joint product by co-extrusion with one another.

8. An expansion joint web element for use in an expansion joint for joining a pair of substantially parallel edge surfaces of adjacent slabs, said joint comprising a pair of elongated anchor elements of a substantially rigid polymeric material, each adapted to extend along the edge surface of a respective one of said slabs, securing means on each anchor element for securing the respective element to the respective slab edge, and the web element, which in the completed joint is permanently secured to and extends between the two anchor elements, wherein the said web element comprises an elongate member of normally longitudinally folded configuration to be compressible and extensible transversely of the length of the anchor elements, the member having two longitudinal edges which in the completed joint are permanently secured to respective ones of the said anchor elements, and the member having an extensible membrane joined to the folds of the web to resist spreading thereof, thereby constituting spacing means for the said anchor elements for maintaining them at a predetermined spacing from one another, said membrane being adapted to rupture during normal movement of said slab surfaces away from each other in operation.

9. The invention as claimed in claim 8 wherein one of said two longitudinal edges of said elongate web has a pronounced bead, and the respective anchor element has a channel adapted to receive and retain said bead, said bead being permanently secured in said channel after insertion therein by means of an adhesive.

10. The invention as claimed in claim 8, wherein said web and at least one of said anchor elements is formed integrally as a joint product by co-extrusion with one another.

11. A method of forming an expansion joint between a pair of substantially parallel edge surfaces of adjacent slabs of settable material, said expansion joint comprising first and second elongate anchor elements of substantially rigid polymeric material and an elongate, laterally compressible and extensible web of substantially more flexible polymeric material than that of the said anchor elements with the longitudinal edges thereof secured permanently to the respective anchor elements, wherein at least one of the two longitudinal edges of the web has a pronounced bead and a corresponding first one of the anchor elements has a channel adapted to receive and retain the said bead said method comprising the steps of:

a. casting a first slab with the said first anchor element embedded therein to be thereby secured thereto, b. with the second anchor element permanently joined to the respective longitudinal edge of the web inserting the said bead in the channel of the first anchor element and permanently securing it therein by means of an adhesive, the anchor elements being positioned at a preselected spacing from one another, and c. casting a second slab with the second anchor element embedded therein to be thereby secured thereto.

12. A method as claimed in claim 11, including inserting a compressible elongated block of preselected dimensions contiguous to the edge surface of said first slab before casting said second slab, said block serving as a form for casting of the edge surface of said second concrete slab.

* * * * *